United States Patent [19]

Jacob et al.

[11] Patent Number: 4,656,688

[45] Date of Patent: Apr. 14, 1987

[54] HOUSING FOR A VACUUM CLEANER

[75] Inventors: Gernot Jacob, Weissach-Flacht; Leon Radom, Ellhofen, both of Fed. Rep. of Germany

[73] Assignee: Progress-Elektrogerate Mauz & Pfeiffer GmbH & Co., Fed. Rep. of Germany

[21] Appl. No.: 780,514

[22] Filed: Sep. 26, 1985

[30] Foreign Application Priority Data

Oct. 1, 1984 [DE] Fed. Rep. of Germany ... 8428850[U]

[51] Int. Cl.[4] ..... A47L 5/28

[52] U.S. Cl. ..... 15/327 F; 15/323; 15/344; 15/350; 15/410

[58] Field of Search ..... 15/344, 327 R, 327 F, 15/323, 410, 327 E

[56] References Cited

U.S. PATENT DOCUMENTS

| | | | |
|---|---|---|---|
| 2,532,264 | 11/1950 | Smith | 15/323 X |
| 2,794,513 | 6/1957 | Hultberg et al. | 15/327 F X |
| 3,246,359 | 4/1966 | Griffiths | 15/323 |
| 3,253,294 | 5/1966 | Waters | 15/323 |
| 3,668,842 | 6/1972 | Batson et al. | 15/327 R X |
| 3,883,922 | 5/1975 | Fleischhauer | 15/327 R |
| 4,554,700 | 11/1985 | Lyman | 15/323 |

FOREIGN PATENT DOCUMENTS

| | | | |
|---|---|---|---|
| 1539512 | 8/1968 | France | 15/323 |

*Primary Examiner*—Chris K. Moore

*Attorney, Agent, or Firm*—Kline, Rommel & Colbert

[57] ABSTRACT

A housing for a hand vacuum cleaner having a front dust chamber and a rear motor chamber separated from each other by a baffle, a dust chamber cover linked at the baffle, and a tightly connected motor chamber cover. In the area adjacent to the motor chamber cover there is designed a handle hollow in the dust chamber cover. This handle hollow is partially covered by a handhold which may be arranged at the motor chamber cover as an integral part thereof. In another embodiment of the housing, the handhold is incorporated in the dust chamber cover. At the motor chamber cover there may be arranged a cross-piece projecting toward the dust chamber cover, covering the rear area of the handle hollow and supporting a cross-piece of the dust chamber cover, thus providing a particularly robust handhold.

6 Claims, 5 Drawing Figures

HOUSING FOR A VACUUM CLEANER

This invention relates to improvements in housings for hand vacuum cleaners.

Hand vacuum cleaners usually have a handhold provided as a separate structural member in a cavity made in the dust chamber cover thereof, in juxtaposition so that the operating person may readily position the vacuum cleaner, for instance, in an elevated position, for vacuum cleaning upholstery.

A handhold as so inserted in the dust chamber cover involves higher expenses for producing the vacuum cleaner housing and renders it more complicated. Also, in the course of the useful life of the hand vacuum cleaner the handhold inserted as a separate structural member may loosen so that the vacuum cleaner cannot be handled perfectly anymore. Furthermore, inserted as a separate structural member the handhold impedes the efforts of providing the vacuum cleaner housing with a particularly smooth and simple shape.

The object of the invention is to improve the housing for a hand vacuum cleaner of the above kind in a way to enable the operating person to perfectly handle the vacuum cleaner over its whole lifetime, and also to provide the housing with a particularly smooth and simple shape.

According to the invention this object is achieved by designing the handhold in one piece with at least one of the covers. Such a design ensures that over the whole lifetime of the vacuum cleaner the handhold does not loosen from the housing, thus providing a perfect handling of the vacuum cleaner. Moreover, by such a design the vacuum cleaner housing has a simplified, particularly smooth shape, which is desirable from the stylistical point of view. Since such a design does not bring about any problems when opening the mould of the housing, the costs for producing the housing of the invention are considerably lower.

Suitably the handhold is arranged as an integral part of the motor chamber cover and projects therefrom towards the dust chamber cover in a way that it overlaps the rear area of the handle hollow integrated in the dust chamber. As the motor chamber cover is tightly connected with the bottom portion of the motor chamber, the vacuum cleaner may be safely held by the handhold which, in this way, is arranged at the motor chamber cover.

However, the handhold may be designed also inside the dust chamber cover. In this case there is suitably arranged a grip opening in the dust chamber cover of the front area of the handle hollow, which grip opening is limited by a cross-piece being the handhold and extending over the rear area of the handle hollow, approximately up to the baffle. As in the closed state the swingably arranged dust chamber cover snaps into the bottom portion of the dust chamber, also this design enables the operating person to hold the vacuum cleaner safely by the handhold.

Preferably the motor chamber cover may comprise a projecting cross-piece supporting the cross-piece of the dust chamber cover. The advantage of this embodiment is that in this way the handhold is particularly robust.

Further, the dust chamber cover may have inserting tongues. Preferably, the dust chamber cover may be linked by two lateral hinges at the baffle of the housing or of the motor chamber cover. Thus, if the handle or a second cross-piece is arranged at the motor chamber cover, the hollow-shaped bottom of the dust chamber cover is swung around the projecting end of the handhold. When the vacuum cleaner is used, the handhold can be easily seized by introducing the fingers into the hollow. The hinges may be integral with the dust chamber cover.

Perferably, the dust chamber cover may be made in one piece with the motor chamber cover and connected therewith by means of a film hinge. In this case there is no need to link the dust chamber cover at the baffle so that the vacuum cleaner housing has a particularly simple design.

Further features, advantages and details of the invention will become evident from the following description of some of the preferred embodiments as well as from the drawings.

Figure 1:
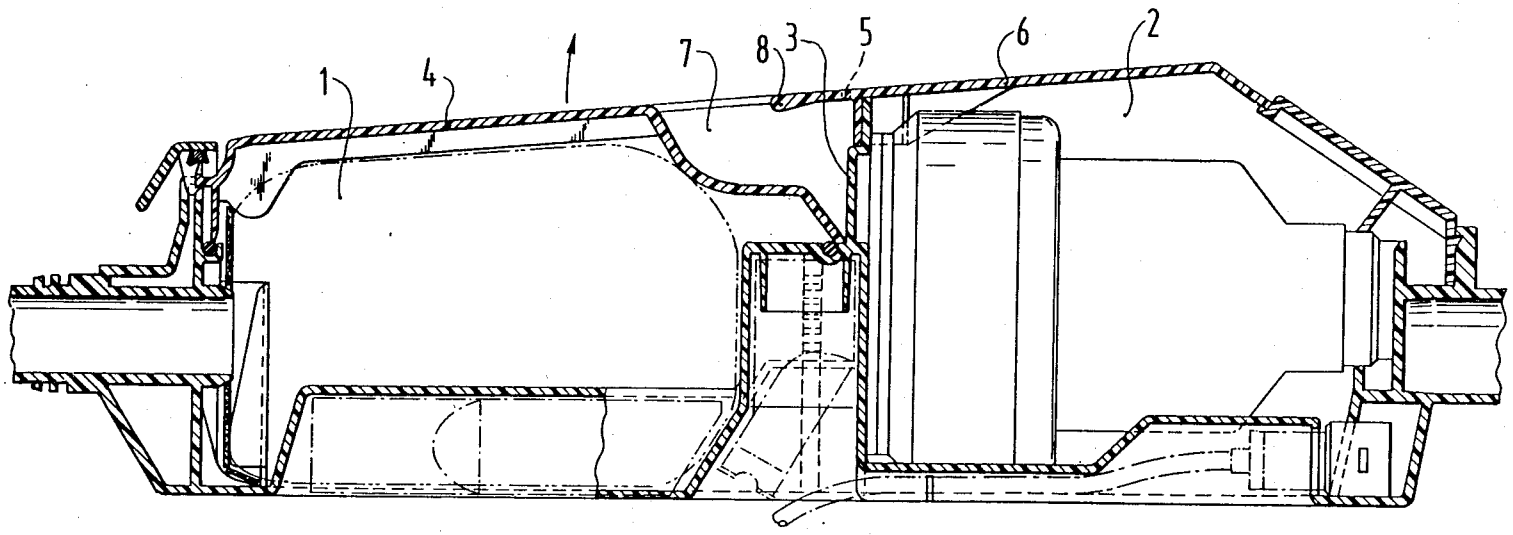
FIG. 1 shows a longitudinal cross-section through a first embodiment of the vacuum cleaner housing according to the invention.
Figure 2:
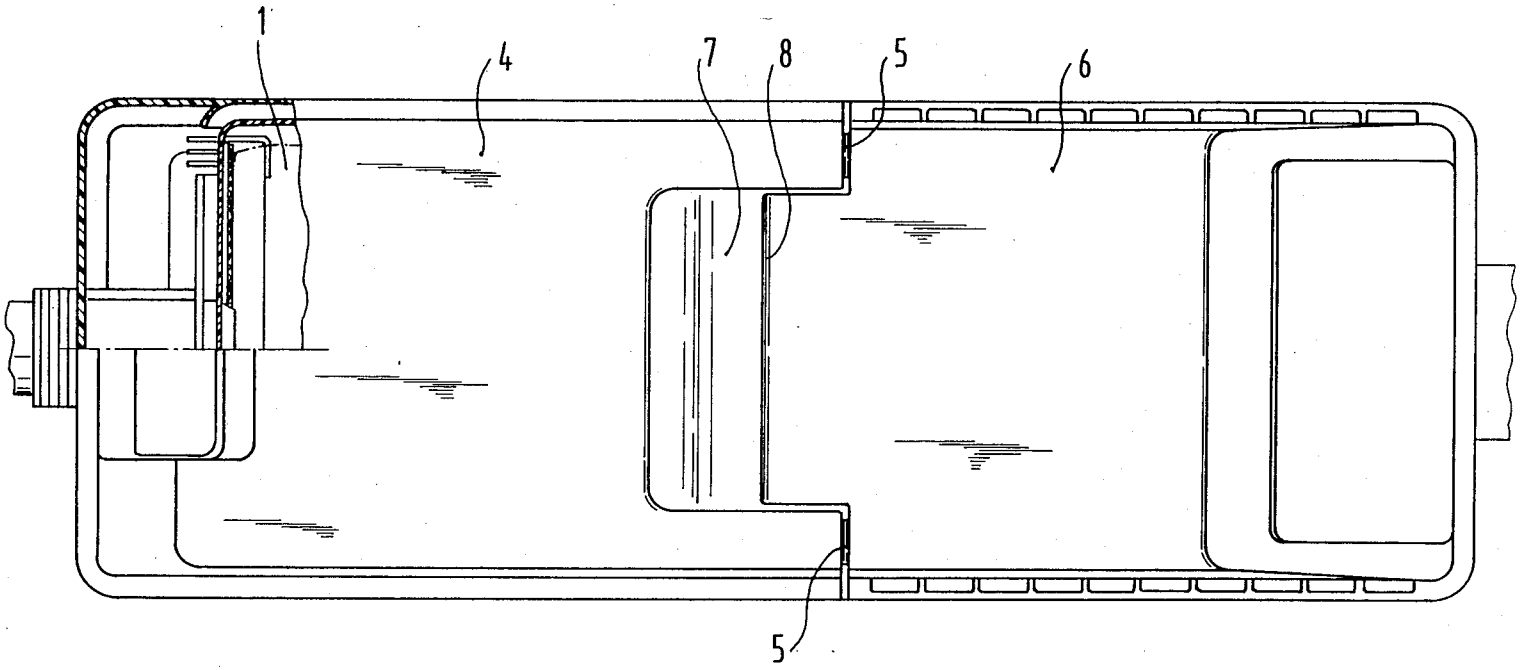
FIG. 2 shows a plan view to the embodiment according to FIG. 1.

The housing for a hand vacuum cleaner shown in FIGS. 1 and 2 has a front dust chamber 1 and a rear motor chamber 2 separated from each other by a baffle 3. A dust chamber cover 4 is linked at the baffle 3 by two lateral hinges 5 and swingable in the direction of the arrow in FIG. 1. A motor chamber cover 6 is tightly screwed with the bottom portion of motor chamber 2.

In the area adjacent to the motor chamber 2 there is designed a handle hollow 7 in the dust chamber cover 4. This handle hollow is partially covered by a handhold 8 which is arranged at the motor chamber cover 6 as an integral part thereof. When the vacuum cleaner is used, handhold 8 may be easily seized by introducing the fingers of the operating person into the handle hollow 7 so that the vacuum cleaner may be lifted into an appropriate position e.g. for vacuum cleaning upholstery.

Figure 3:
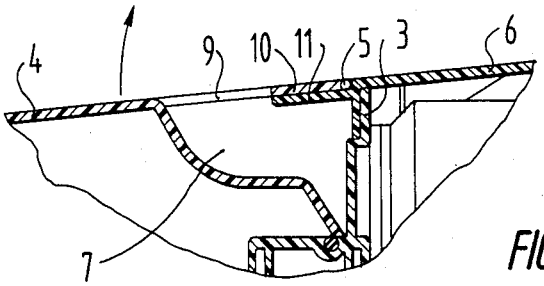
FIG. 3 shows a longitudinal cross-section through the handhold area of a second embodiment of the housing according to the invention.
Figure 4:
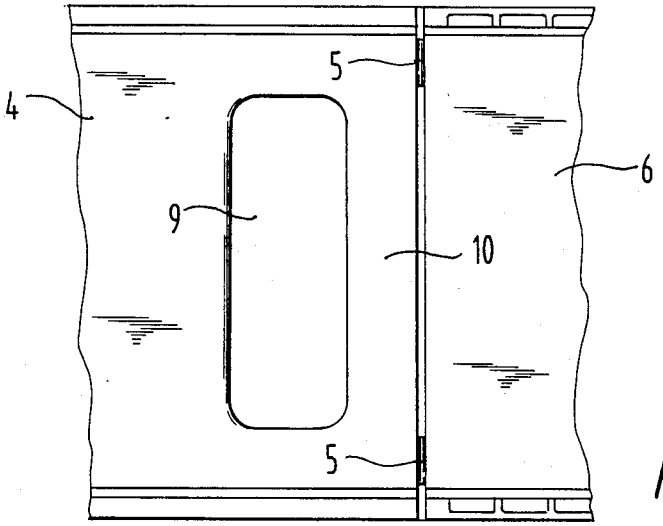
FIG. 4 shows a plan view to the handhold area according to FIG. 3.

In the embodiment of the vacuum cleaner housing shown in FIGS. 3 and 4 the handhold is incorporated in the dust chamber cover 4. Above the front area of the handle hollow 7 the dust chamber cover 4 has a grip opening 9 which is limited by a cross-piece 10 covering the rear area of the handle hollow, approximately up to baffle 3. At the motor chamber cover 6 there is arranged a cross-piece 11 projecting towards the dust chamber cover 4 supporting cross-piece 10 of dust chamber cover 4, thus providing a particularly robust handhold.

Figure 5:
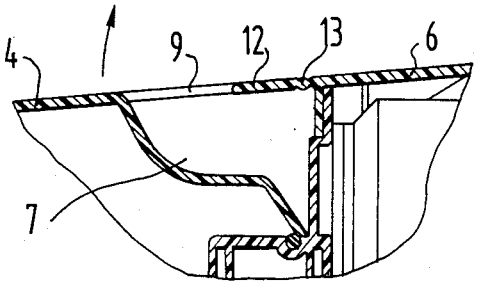
FIG. 5 shows a longitudinal cross-section through the handhold area of another embodiment of the housing.

FIG. 5 shows a further embodiment of a handhold of a vacuum cleaner housing where dust chamber cover 4 and motor chamber cover 6 are made in one piece. Analogus to the embodiment according to FIGS. 3 and 4 the dust chamber cover has above the front area of the handle hollow 7 a grip opening 9 which is limited by a cross piece 12 being the handhold, which cross-piece is connected with the motor chamber cover 6 by a film hinge 13. Said film hinge 13 allows to open the dust chamber cover 4 by swinging it in the direction shown by the arrow in FIG. 5. In this embodiment the dust chamber cover need not be linked by lateral hinges at baffle 3.

We claim:

1. A housing for a hand vacuum cleaner having a front dust chamber provided with a swingably arranged dust chamber cover and a rear motor chamber provided with a tightly connected motor chamber cover and being separated from the dust chamber by a baffle, a handle hollow designed in the area of the dust chamber cover adjacent to the motor chamber cover, and a handhold partially covering said handle hollow, said handhold being arranged at the motor chamber cover as an integral part thereof.

2. A housing for a hand vacuum cleaner having a front dust chamber provided with a swingably arranged dust chamber cover and a rear motor chamber provided with a tightly connected motor chamber cover and being separated from the dust chamber by a baffle, a handle hollow designed in the area of the dust chamber cover adjacent to the motor chamber cover, and a handhold partially covering said handle hollow, the front area of the handle hollow of the dust chamber cover having a grip opening and a cross-piece delimiting the upper reaches of the same, said cross-piece extending above said handle hollow and reaching approximately up to the baffle and defining said handhold, the motor chamber cover having a projecting cross-piece supporting said cross piece of the dust chamber cover.

3. A housing as specified in claim 1 and including two lateral hinges provided at the baffle of the housing for linking the dust chamber cover thereto, and wherein, in the closed state, the dust chamber cover snaps into the bottom portion of the dust chamber.

4. A housing as specified in claim 3 wherein said hinges are made integral with the dust chamber cover.

5. A housing as specified in claim 2 and including two lateral hinges provided at the baffle of the housing for linking the dust chamber cover thereto, and wherein, in the closed state, the dust chamber cover snaps into the bottom portion of the dust chamber.

6. A housing as specified in claim 1 wherein the dust chamber cover is made in one piece with the motor chamber cover and is linked therewith by a film hinge.

* * * * *